US005372456A

United States Patent [19]

Langemann

[11] Patent Number: 5,372,456

[45] Date of Patent: Dec. 13, 1994

[54] IRRIGATION CONTROL STRUCTURE

[75] Inventor: Peter J. Langemann, Coaldale, Canada

[73] Assignee: The Board of Directors of the St. Mary River Irrigation District, Lethbridge, Canada

[21] Appl. No.: 135,892

[22] Filed: Oct. 13, 1993

[30] Foreign Application Priority Data

May 14, 1993 [CA] Canada ..... 2096269

[51] Int. Cl.[5] ..... E02B 7/20

[52] U.S. Cl. ..... 405/92; 137/392; 405/100; 405/102

[58] Field of Search ..... 405/100, 101, 102, 92, 405/37, 106, 104, 94, 95, 96; 137/392

[56] References Cited

U.S. PATENT DOCUMENTS

| | | | |
|---|---|---|---|
| 425,231 | 4/1890 | Lang | 405/102 |
| 2,689,459 | 9/1954 | Mayo | 405/101 |
| 4,332,507 | 6/1982 | Wakamori et al. | 405/92 |
| 4,600,844 | 7/1986 | Atkins | 137/392 X |
| 4,612,949 | 9/1986 | Henson | 137/392 X |
| 4,624,280 | 11/1986 | DePirro | 137/392 |
| 4,797,027 | 1/1989 | Combes et al. | 405/92 |
| 5,156,489 | 10/1992 | Replogle | 405/101 X |
| 5,216,288 | 1/1993 | Greene | 137/392 X |

*Primary Examiner*—Dennis L. Taylor

*Attorney, Agent, or Firm*—Cowan, Liebowitz & Latman

[57] ABSTRACT

An irrigation water control gate for controlling the amount of water delivered downstream. The gate includes a frame and a pair of panels in the frame hingedly connected at adjoining horizontal side edges and forming a wedge shape extending upstream. The upper panel forms the crest of the gate which is raised or lowered on cables. Water level sensing means positioned above the crest for movement with the crest activates control means and cable driving means to move the crest so that water flowing over the crest is maintained at a constant depth.

9 Claims, 3 Drawing Sheets

IRRIGATION CONTROL STRUCTURE

This invention relates to flow regulators and more particularly to irrigation control gates or weirs.

DISCUSSION OF PRIOR ART

Developments in irrigation technology during the last decade have emphasized conservation and control of water in open water supply channels. The control of water levels in canals upstream of water control structures with electronic and mechanical devices has become common. Constant and accurate control of the water flowing to the downstream side of these devices in situations where the water that is being diverted out of the larger channel to individual farmers, or groups of farmers, by means of smaller canals is desirable.

The methods available to control downstream flow measure rely on measurement of the water after it has flowed over an adjustable turnout. The control mechanism then attempts to adjust that turnout to maintain a predetermined flow down the open channel that delivers the water to the farmer.

Such a control means includes a monitor for measuring the depth of water. If the predetermined depth of water is exceeded, the electronic circuit is required to adjust the turnout. In prior devices where a probe is used, the probe is stationary and water levels are measured by the level of the liquid on the probe or simply by the water making an electrical contact between probes. A dipping probe is sometimes used to measure water levels where a small motor raises and lowers the probe and a potentiometer is used to regulate a voltage that is proportional to the water level. These devices require higher power levels and considerable support circuitry in relation to the probes and circuitry used in this application.

After a selected interval the monitor again checks the water level and if the level is still too high a further adjustment is made. However, once the water level reaches the predetermined level, the control must again signal the adjustable turnout to increase the flow a small amount otherwise the level continues to drop until the flow level is below the predetermined level. At which point the control must again signal the adjustable turnout to increase the flow. This often results in "over steering" or "under steering" and creates what is described as a "hunting" effect and results in high power consumption.

Attempts to prevent "hunting" in the control of such gates have not been entirely effective due to high cost and large power requirements.

The present invention seeks to overcome the control problems of prior devices by the provision of a gate which incorporates "feed forward" and "overshot" concepts which control the amount of water before it reaches an adjustable turnout. This design is less costly and requires reduced power.

Although the concept of "feed forward" control is not new, it is not currently used in the downstream control of open water channels. The concept is used in closed pipeline applications wherein the liquid is measured upstream of the discharge valve and that valve is adjusted to the desired flow rate.

The "overshot" gate design is one of several designs commonly used in irrigation works. As an upstream control it consists of a single panel hinged on the bottom, folding downstream and moved up or down by cables attached to a drum on a winch. This is referred to as a "drop leaf" gate. There is a lot of water pressure on the top side of the panel requiring a considerable amount of power to raise and maintain its position, and causes the gate to drop immediately if the cable is disconnected.

A further problem arises where orifice type turnouts are used. In an orifice (pipeline) type of turnout, the trash that is common in open channels accumulates at the opening and eventually obstructs the flow. In an older style automated gate these obstructions interfere with the operation of the gate causing the system to operate more often with higher power consumption. When operating the gate of this invention the adjustable turnout to which the water flows after leaving this gate is always wide open eliminating the possibility for trash accumulation.

A further problem arises in view of the fact that the standard drop leaf gate moves in an arc, a non-vertical, non-linear movement, therefore its position cannot be monitored easily. When the cable connected to a drop leaf crest winds up or down the amount of movement changes as the cable reaches succeeding layers of cable on the winch drum.

SUMMARY OF THE INVENTION

The present invention seeks to overcome the problems of prior methods and devices by the provision of a control structure or weir for use in measuring and controlling water in an irrigation channel system or the like, said structure comprising a frame adapted to be mounted in an irrigation channel, a gate having an adjustable crest mounted in the frame, drive means for moving the crest vertically, water level sensing means adapted to be positioned in a selected position above the crest for activating the means for moving the crest and moving with the crest whereby the water flowing over the crest is maintained at a constant depth, and water volume can be determined by the relatively constant cross sectional area of water flowing over the crest.

BRIEF DESCRIPTION OF THE DRAWINGS

In the drawings which illustrate a preferred embodiment of the invention.

DESCRIPTION OF THE PREFERRED EMBODIMENT

Figure 1:
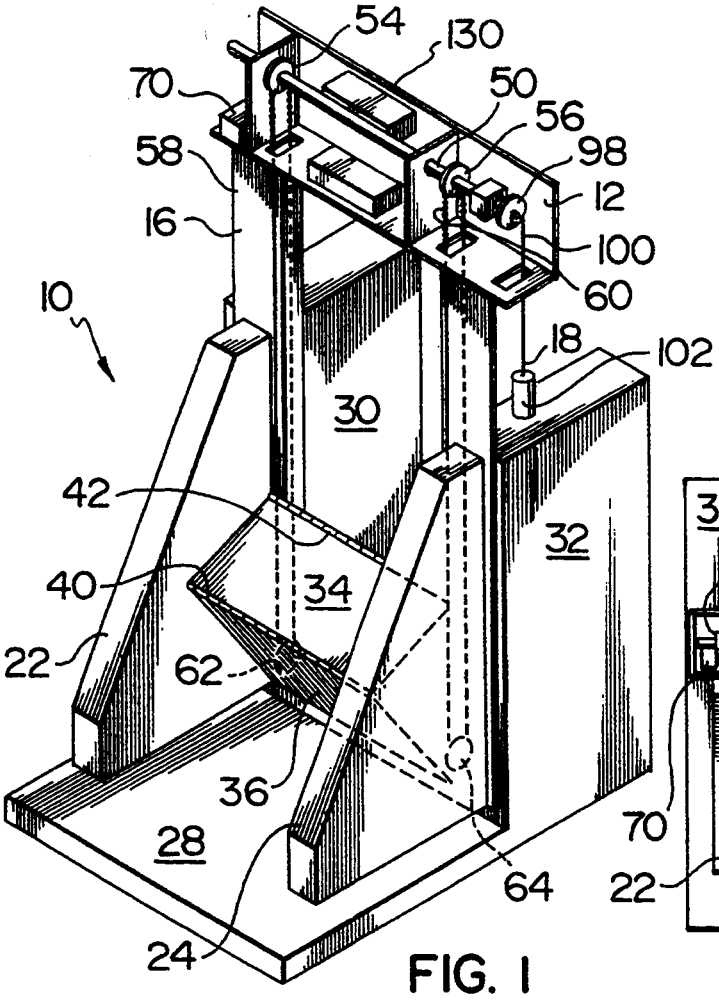
FIG. 1 is a perspective view of a gate for an irrigation canal.

Referring now in detail to the accompanying drawings, a gate structure or weir shown generally at 10 in FIG. 1 includes a horizontal frame member 12 extending across the width of a channel 14, and tubular support members 16 and 18 to which steel wings 22 and 24 respectively are secured.

Figure 2:
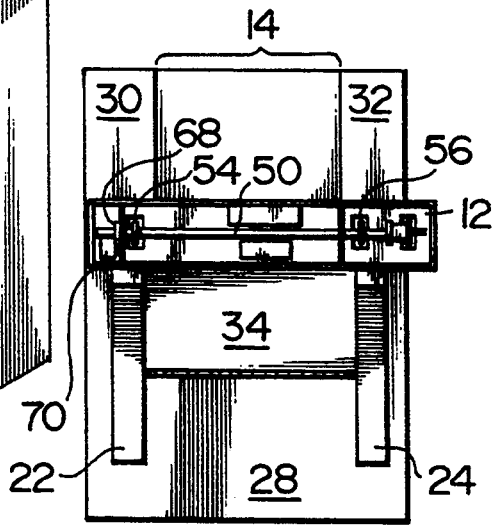
FIG. 2 is a top plan view of the gate of FIG. 1.
Figure 3:
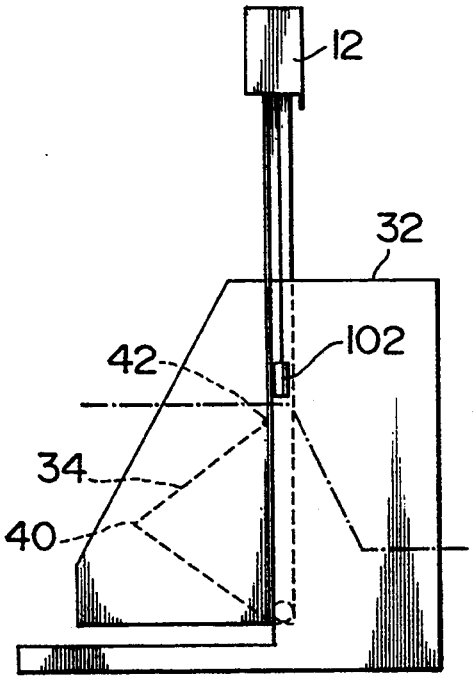
FIG. 3 is a side view.
Figure 4:
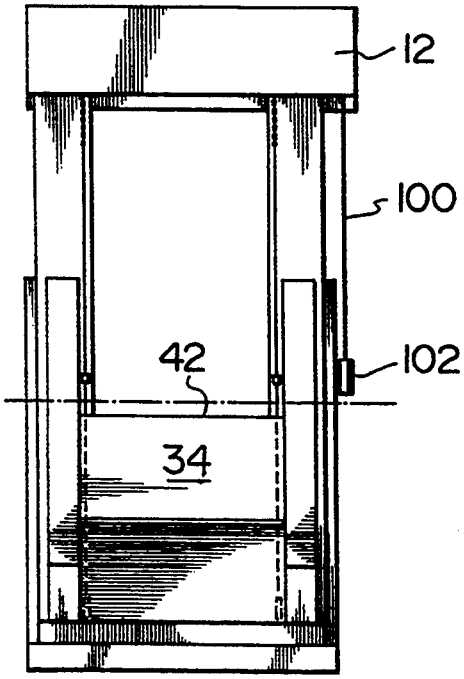
FIG. 4 is a front view.

With reference to FIGS. 2, 3 and 4, the gate structure 10 is mounted immediately upstream of a standard turnout (not shown) on a concrete floor 28 and retaining walls 30 and 32.

Upper and lower panels 34 and 36 respectively connected by a hinge 40 extend between the wings 22 and 24. An upper edge of the panel 34 forms an adjustable crest 42 and a lower edge of the panel 36 is attached at the bottom of the weir 10 so that water flowing in the channel 14 must pass over the adjustable crest 42. The panels 34 and 36 are preferably positioned to form a wedge which is directed upstream. In this configuration, water pressure on the upper panel 36 and the lower panel will be almost equal and therefore less power is required to move the crest 42 than might be required in the case of a drop leaf structure.

The gate 10 is provided with drive means including a shaft 50 rotatably mounted on the horizontal frame member 12, which has a pair of sprockets 54 and 56 provided with flexible members or chains 58 and 60 respectively which also entrain sprockets 62 and 64.

If desired, the part of the chains 58 and 60 can be replaced by cable so that link chain extends over the sprockets 54 and 56, and cable extends around pulleys rather than sprockets. The chain and cable flexible members 58 and 60 are connected to the upper panel 34 of the gate 10 for raising and lowering the crest 42.

As shown in FIG. 2 the shaft 50 also carries a gear 68 interconnecting the shaft and a 12 volt motor 70.

Figure 5:
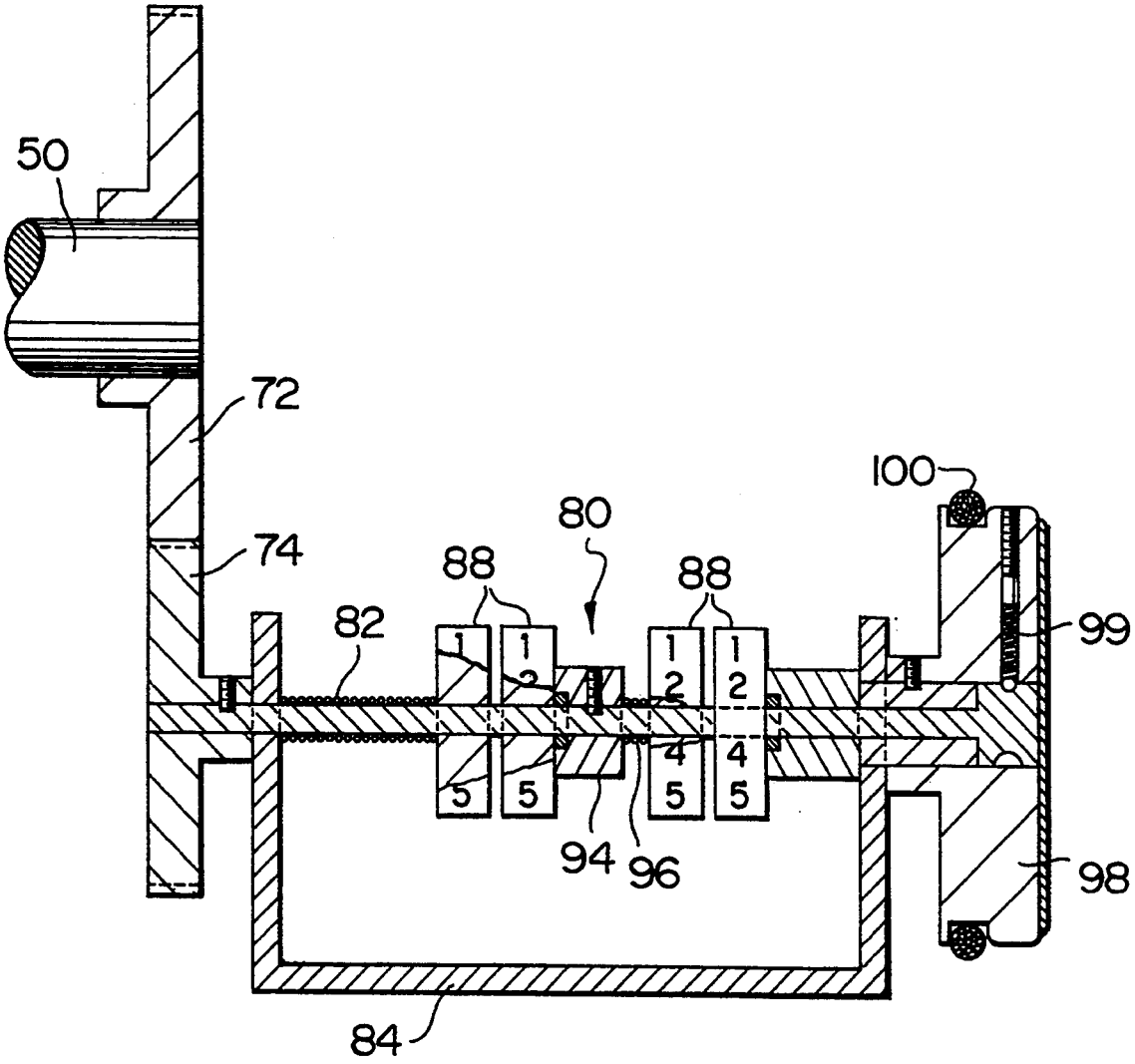
FIG. 5 is a perspective view of the control.

A further pair of gears 72 and 74 connect one end of the shaft 50 and the counter mechanism 80 shown in detail in FIG. 5. The counter mechanism 80 has a shaft 82 journaled for rotation in a frame 84. The shaft 82 has two counters 88 indicating elevation of the crest 42 of the gate 10 and two counters 88 for indicating the position of probes 90 and 92 shown in FIG. 6. The probes 90 and 92 are constructed of nickel or any other suitable corrosion resistant conductive material.

A ring 94 having a set screw and a spring 96 separates the counters. The other end of the shaft 82 is provided with a pulley 98 retained on the shaft 82 by a set screw and spring biased tension means 99. A cable 100 on the adjustment wheel is connected to the probes 90 and 92. The pulley 98 rotates with the shafts 50 and 82 or may be rotated independently by overcoming the friction of the tension means 99.

Figure 6:
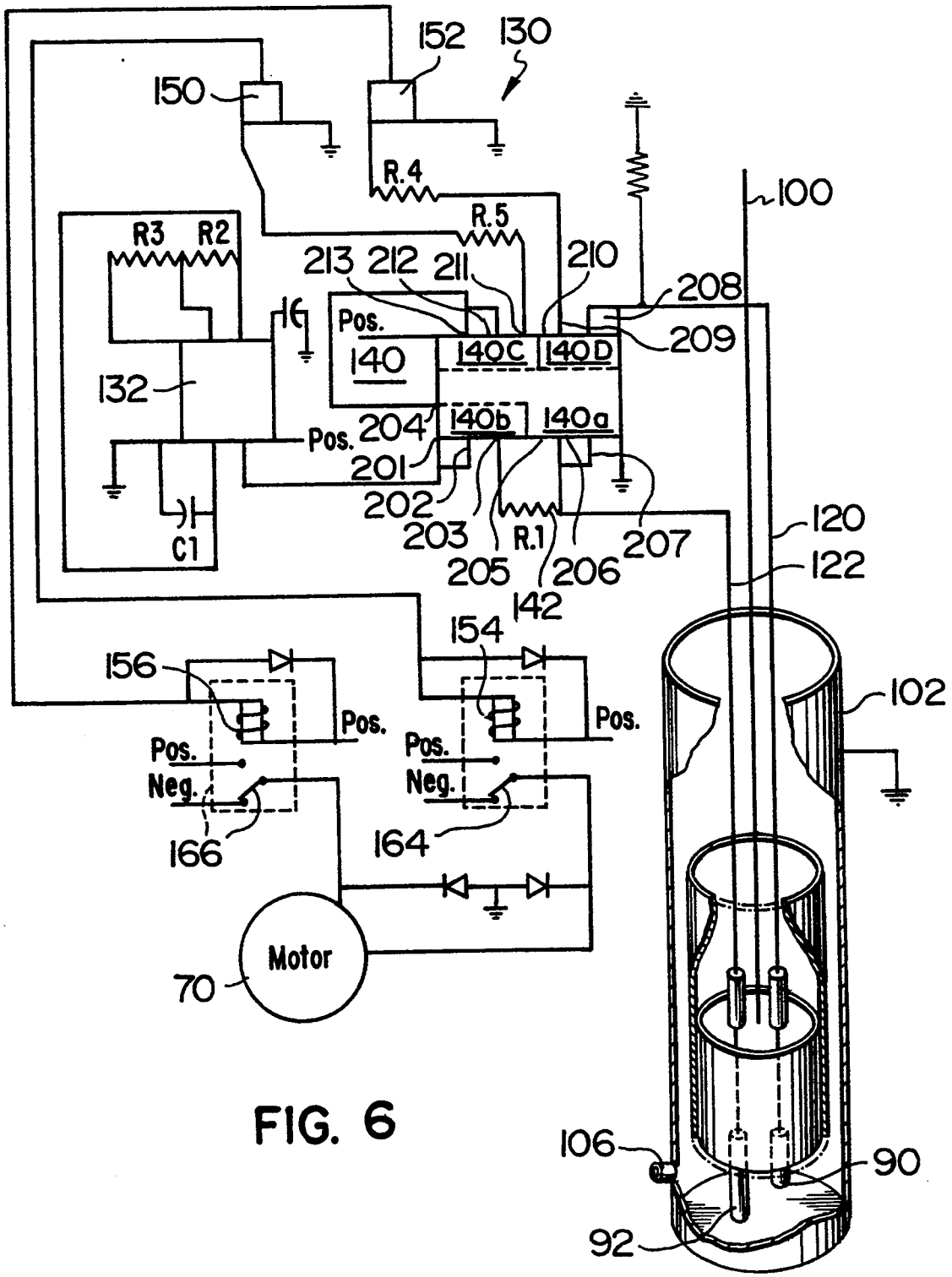
FIG. 6 is a schematic of the electrical circuits for controlling the gate.

As shown in FIG. 6, the probes 90 and 92 are preferably enclosed in a protective housing 102 having a closed bottom and a water inlet 106. The upper and lower probes 90 and 92 are connected by conventional coiled wire type extensible conductors 120 and 122 to the electronic control circuit indicated generally at 130 which includes an integrated circuit timer 132, and a trigger 140 having gates A, B, C and D (140*a*, 140*b*, 140*c* and 140*d*). The lower probe 92 is connected to gates 140*a* and 140*b* by conductor 122 through a resistor 142, and the upper probe 90 is connected through conductor 120 to the gate 140*d*. The electronic control circuit 130 also includes NPN transistors 150 and 152 to operate relays 154 and 156 controlling the reversible 12 volt motor 70. Manually operated switches 164 and 166 are provided to operate the motor 70 for rotation in either direction. The motor 70 is powered by a conventional heavy duty 12 volt power supply 170. The negative connection of the housing 162 and the probes 90 and 92 to the control circuit 130 is provided through the water.

The integrated circuit 140 which is a type known as a Schmitt trigger, has pins 201, 202 and 203 at gate 140*a*, and pins 205, 206 and 207 at gate 140*b*. The gate 140*d* has pins 208, 209 and 210, and gate 140*c* is provided with pins 211, 212, 213 and 214.

The integrated circuit timer 132 is designed to control only the movement of the lower probe 92 in regulating the rate at which the crest 42 is lowered in response to changing water levels. The timer 132 has its output mainly on pin 201 of the integrated circuit 140 to generate a negative pulse from pin 203 through a resistor 142 to the lower probe 92. This circuit maintains a negative pulse on the lower probe circuitry connected to pins 205 and 206 of the integrated circuit 140.

While there is a negative current to pins 205 and 206, the output of gate 140*a* in pin 204 would be positive, and pin 204 is connected to pins 212 and 213 which are the inputs to gate 140*c*. Gate 140*c* generates a negative current on its output pin 211 maintaining the relay 154 in the negative or off position.

The timer circuit 132 maintains a negative current in the circuit of lower probe 92 and is adapted to do so whether or not the probe 92 is in the water.

In use, the gate 10 is set at a selected level to deliver water over the crest at a depth to provide the desired quantity downstream. The crest 42 may be moved vertically by using manual switches 164 and 166. The probes 90 and 92 are set by rotating the pulley 98 to reel in or pay out cable 100 so that the distance between the level of the lower probe 92 and the level of the crest 42 is equal to the depth of the water to be delivered over the gate 10.

During operation, the flow of water from upstream may vary due to climatic conditions in which case the control circuit must move the crest 42 to maintain a constant depth of water over the crest 42.

When the water touches the lower probe 92 contact is made with the power supply and the unit is at rest. Only a few micro amps of power are required to maintain this position. If the water level drops or the probe is raised so that the water does not complete the contact, the electronic circuit 130 after a preset time interval activates the 12 volt motor 70 to simultaneously lower the crest 42 of the weir and the lower probe 92 until the probe 92 again contacts the water. This contact closes the circuit putting it at rest.

If the water level rises or the lower probe 92 is manually lowered so that the water provides a contact with the upper probe 90 the circuit immediately activates the motor 160 to simultaneously raise the probe and the crest 42 until contact is broken with the upper probe 90 and the circuit rests. With this arrangement the differential between the crest of the weir and surrounding water level remains relatively constant without over or under steering, minimizing the "hunting" effect.

The CMOS Integrated Circuit 132 is a micro power 555 timer and CMOS Integrated Circuit 140 is a CMOS 7093 4 gate 2 input Schmitt trigger.

The integrated circuit 132 is wired to run as an astable multivibrator with a 100/1 duty cycle. Generally a cycle that produces an output at gate 140*b* that is 1 second positive and 100 seconds negative is acceptable. This output is connected to the lower probe 92 through a 680*k* resistor, the lower probe 92 is then connected to the inputs of gate 140*a* and passed on to the inputs of gate 140*c* where the signal is inverted and connected to transistor 150 where it is amplified and activates relay 154 which in turn is connected to the motor 70 in a configuration that controls movement of crest 42 and the probes 90 and 92 in one direction.

The upper probe 90 is also connected to the inputs on integrated circuit gate 140*d* which passes the signal on to transistor 152 and relay 156. The output from the relay 156 is connected to the motor 70 in a configuration that drives both the crest 42 and probes 90 and 92 in the other direction.

It is desirable to prevent the gate from being lowered unnecessarily or too rapidly so as to release large quantities of water so as to cause flooding.

The timer circuit 132 provides a 2 second negative pulse through the control circuity 130 at 2 minute intervals. This 2 second pulse restricts lowering the gate 10 to 2 seconds every 2 minutes resulting in a considerable amount of time being required to lower the gate 10 a considerable distance and avoid flooding problems. Large movements of the crest 42 of the gate 10 require the operator to override the control system 130 through the use of the manually operable switches 164 and 166. The timer and gate control circuit 130 account for small fluctuations in the water level and the timer 132 switches to negative for 2 seconds providing a negative state at the pins 201 and 202 of the Schmitt trigger resulting in a positive pulse from the pin 203 with the result that the probe 92 is lowered if the probe 92 is not in contact with the water. If the lower probe 92 is in contact with the water the positive pulse from the timer 132 will be overridden by the negative orientation of the probe 92 being in touch with the water and the motor 70 will not be activated to lower the probe 92 and the crest 42.

The embodiments of the invention in which an exclusive property or privilege is claimed are defined as follows:

1. A control structure or weir for use in measuring and controlling water in an irrigation channel system or the like, said structure comprising:

a frame adapted to be mounted in an irrigation channel;

a gate having an adjustable crest mounted in the frame;

drive means for moving the crest vertically;

water level sensing means adapted to be positioned in a selected position above the crest for activating the means for moving the crest and moving with the crest whereby the water flowing over the crest is maintained at a constant depth; and water volume can be determined by the relatively constant cross sectional area of water flowing over the crest.

2. A water control structure as claimed in claim 1 wherein panels of said adjustable gate are hingedly connected to form a variable wedge shape directed upstream, a lower one of said panels having a lower edge maintaining contact with a bottom wall of the channel, whereby water pressure on the underside and top side of the panels is substantially equal.

3. A water control structure as claimed in claim 1 wherein the crest is connected to drive means comprising a chain and sprocket on a shaft adapted to move the crest vertically.

4. A water control structure as claimed in claim 3 wherein said drive means is activated by means for sensing the level of the water flowing over said crest.

5. A water control structure as claimed in claim 4 wherein the means for sensing the level of the water is a probe on a cable adjustably connected to the shaft for raising and lowering the gate whereby the probe is raised and lowered with the gate.

6. A water control structure as claimed in claim 1 wherein the drive means is an electric motor, the sensing means is a lower probe to be positioned a selected distance above the crest, and an upper probe positioned above and moveable with the lower probe and the crest; first and second relays are connected to lower and upper probes respectively for operating the drive means, whereby the level of the water flowing over the crest completes a circuit through integrated circuit means while the water is at a selected level, and, when the water level drops, a circuit is completed through said integrated circuit means to close said first relay and operate the drive means thereby lowering the crest and the lower probe until the lower probe contacts the water; and whereby a rising water level contacts the upper probe completing a circuit through the second relay to operate the drive means to raise the crest and the upper probe until the upper probe ceases to contact the water.

7. A control structure as claimed in claim 6 wherein circuits of the upper and lower probes are energized by pulse generating means and signals received from the upper and lower probes are amplified by amplification means.

8. A control structure as claimed in claim 6 wherein timing means delays operation of the drive means to compensate for brief fluctuation in the water level and reduce hunting, corrosion of probes, and energy consumption.

9. A control structure as claimed in claim 1 wherein said upper and lower probes are in a protective housing having a closed bottom, and a water inlet in a side wall of the housing.

* * * * *